US012102245B2

(12) United States Patent
Rietema

(10) Patent No.: US 12,102,245 B2
(45) Date of Patent: Oct. 1, 2024

(54) FLOATING BEVERAGE HOLDING APPARATUS

(71) Applicant: Justin Rietema, Fort Lauderdale, FL (US)

(72) Inventor: Justin Rietema, Fort Lauderdale, FL (US)

( * ) Notice: Subject to any disclaimer, the term of this patent is extended or adjusted under 35 U.S.C. 154(b) by 77 days.

(21) Appl. No.: 17/360,848

(22) Filed: Jun. 28, 2021

(65) Prior Publication Data

US 2022/0408951 A1 Dec. 29, 2022

(51) Int. Cl.

| | |
|---|---|
| ***A47G 23/02*** | (2006.01) |
| ***B63B 7/08*** | (2020.01) |
| ***B63B 21/20*** | (2006.01) |

(52) U.S. Cl.

CPC ..... *A47G 23/0216* (2013.01); *B63B 7/08* (2013.01); *B63B 21/20* (2013.01); *A47G 2200/02* (2013.01)

(58) Field of Classification Search

CPC ..... A45C 2200/20; A45C 2200/02; A45F 2200/0583; A47G 2200/02; A47G 23/0216; A63B 2225/605; A63B 31/00; B63C 9/08; B63C 9/1255; B63C 9/155; B63B 7/08; B63B 21/20; B63B 22/24

USPC ... 441/129, 80, 106, 131, 40, 108, 136, 123, 441/30; 119/815; 220/560; D7/619.1

See application file for complete search history.

(56) References Cited

U.S. PATENT DOCUMENTS

| | | | | | |
|---|---|---|---|---|---|
| 2,051,281 | A * | 8/1936 | Webber | A47C 15/006 | 441/131 |
| 2,435,497 | A * | 2/1948 | Hajduk | A47C 15/006 | 441/131 |
| 2,724,843 | A * | 11/1955 | Kimball | A47C 15/006 | 441/131 |
| 2,806,471 | A * | 9/1957 | Breese | A61F 5/055 | 602/17 |
| 2,890,467 | A * | 6/1959 | Cowell | B63C 9/155 | 441/123 |
| 3,015,406 | A * | 1/1962 | Nolte | A47G 23/06 | 220/592.27 |
| 3,533,529 | A * | 10/1970 | Helbig | A47G 19/2266 | D7/505 |
| 4,571,194 | A * | 2/1986 | Kiss | A47G 23/0216 | 441/1 |
| 4,887,716 | A * | 12/1989 | Abraham | A47K 3/004 | 206/139 |
| 5,505,353 | A * | 4/1996 | Marsh, Jr. | A45F 5/00 | 224/602 |

(Continued)

*Primary Examiner* — Gideon R Weinerth

(57) ABSTRACT

A floating beverage holding apparatus includes a c-shaped body, a webbing, and a collapsible fastener. The c-shaped body is an inflatable apparatus and includes a top surface, an outer lateral surface, an inner lateral surface, a bottom surface, a lateral opening, and a central opening. The top surface and the bottom surface are perimetrically connected to each other by the outer lateral surface and the inner lateral surface. The central opening is delineated by a curved section of the inner lateral surface and the webbing is terminally connected onto the curved section of the inner lateral surface to receive a beverage container. The lateral opening is delineated in between a first section and a second section of the inner lateral surface. The collapsible fastener is connected onto the outer lateral surface and extended across the lateral opening to secure a beverage container to the c-shaped body.

10 Claims, 6 Drawing Sheets

(56) References Cited

U.S. PATENT DOCUMENTS 5,622,346 A * 4/1997 Story, Jr. ..... A45F 5/02 224/675
5,727,709 A * 3/1998 Nobile ..... B65D 81/3886 220/560
D419,392 S * 1/2000 Schlebusch ..... D7/619.1
6,058,517 A * 5/2000 Hartunian ..... A41D 13/0512 602/18
6,616,493 B2 * 9/2003 Powell ..... A47G 23/0216 206/427
6,659,046 B2 * 12/2003 Schmid ..... A61D 3/00 119/815
D540,031 S * 4/2007 Bouchard ..... A45F 5/02 D3/202
9,149,139 B1 * 10/2015 Rogers ..... B67B 7/16
D873,624 S * 1/2020 Rogers ..... A47C 15/006 D7/619.1
D880,954 S * 4/2020 McCutchen ..... D7/624.2
D944,565 S * 3/2022 Betts ..... D6/601
D945,223 S * 3/2022 Rogers ..... D7/619.1
11,382,442 B2 * 7/2022 Storey-Knight ... A47G 23/0216
11,737,428 B2 * 8/2023 Garfinkel ..... A01K 27/003 119/815
2002/0010053 A1 * 1/2002 Peterson ..... A63B 5/11 482/27
2003/0077958 A1 * 4/2003 Powell ..... A45F 5/02 441/1
2003/0124922 A1 * 7/2003 Sowry ..... B25G 1/102 441/136
2005/0101204 A1 * 5/2005 Zhao ..... B63C 9/155 441/108
2005/0173478 A1 * 8/2005 Gill ..... A45F 5/00 224/148.6
2006/0217014 A1 * 9/2006 Pierce ..... B63C 9/26 441/123
2007/0181080 A1 * 8/2007 Gibson ..... A01K 27/001 119/815
2008/0078788 A1 * 4/2008 Degges ..... A45C 3/10 224/148.1
2010/0102065 A1 * 4/2010 Phelan ..... B63B 1/041 220/737
2010/0252560 A1 * 10/2010 Churchill ..... B63B 35/00 220/592.2
2014/0179183 A1 * 6/2014 Chiu ..... B63B 34/52 441/129
2015/0011135 A1 * 1/2015 Williams, Jr. ..... B63C 9/13 441/108
2015/0225041 A1 * 8/2015 Lovett ..... A45B 11/00 441/32
2015/0232158 A1 * 8/2015 Bouse ..... A24F 19/0092 248/205.2
2016/0022072 A1 * 1/2016 McDowell ..... A47G 23/0216 220/560
2016/0324350 A1 * 11/2016 Rogers ..... A47G 23/0216
2017/0099808 A1 * 4/2017 Garfinkel ..... A01K 13/006
2017/0112313 A1 * 4/2017 Reichle ..... A47G 23/0241
2018/0199742 A1 * 7/2018 Rogers ..... A47G 23/0216
2018/0200578 A1 * 7/2018 Ison ..... A63B 31/00
2018/0257845 A1 * 9/2018 Phelps, III ..... C09J 4/06
2019/0100286 A1 * 4/2019 Kennedy ..... E04H 4/14
2019/0343313 A1 * 11/2019 Sanborn ..... A47G 23/0241
2019/0350393 A1 * 11/2019 Storey-Knight ... A47G 23/0216
2020/0275792 A1 * 9/2020 McCutchen ..... A47G 23/02
2021/0371049 A1 * 12/2021 Ford ..... A45F 5/00

* cited by examiner

FLOATING BEVERAGE HOLDING APPARATUS

FIELD OF THE INVENTION

The present invention relates generally to beverage holding devices. More specifically, the present invention is a floating beverage holding apparatus that can accommodate various sizes of beverage containers while keeping the secured beverage container in the upright position.

BACKGROUND OF THE INVENTION

Floating beverage holders provide an essential functionality for any water related activities such as swimming, snorkeling, water sports and other water related activities that require the user to use both of their hands. Due to the movement of the user and turbulence of the water, existing floating beverage holders tend to move away from the user or tilt, compromising the stored beverage. Furthermore, users generally have to carry multiple floating beverage holders so that different sized beverage containers can be secured. For example, users are not able to use a single floating beverage holder to float a wine bottle and a can beverage due to significant size difference of those two containers.

Therefore, an objective of the present invention is to provide a solution for aforementioned problems. The present invention is able to secure various sizes of beverage containers through a collapsible fastener. The present invention is an inflatable beverage holding apparatus for ease and convenience for travel and storage. The present invention is designed to clip to a user's bathing suit or tie to a user's wrist so that the secured beverage never leaves the user's side. The present invention submerges a portion of the beverage container in the water and puts most of the support near the top of the beverage container to prevent the drink from tipping when it encounters any turbulences. Furthermore, once the beverage container is secured within the present invention, the beverage container does not have to be removed for consumption.

DETAILED DESCRIPTION OF THE INVENTION

All illustrations of the drawings are for the purpose of describing selected versions of the present invention and are not intended to limit the scope of the present invention.

The present invention is a floating beverage holding apparatus that can secure various sizes of beverage containers. The present invention submerges a portion of the beverage container in the water and puts most of the support near the top of the beverage container to prevent the drink from tipping when it encounters any turbulences.

Figure 1:
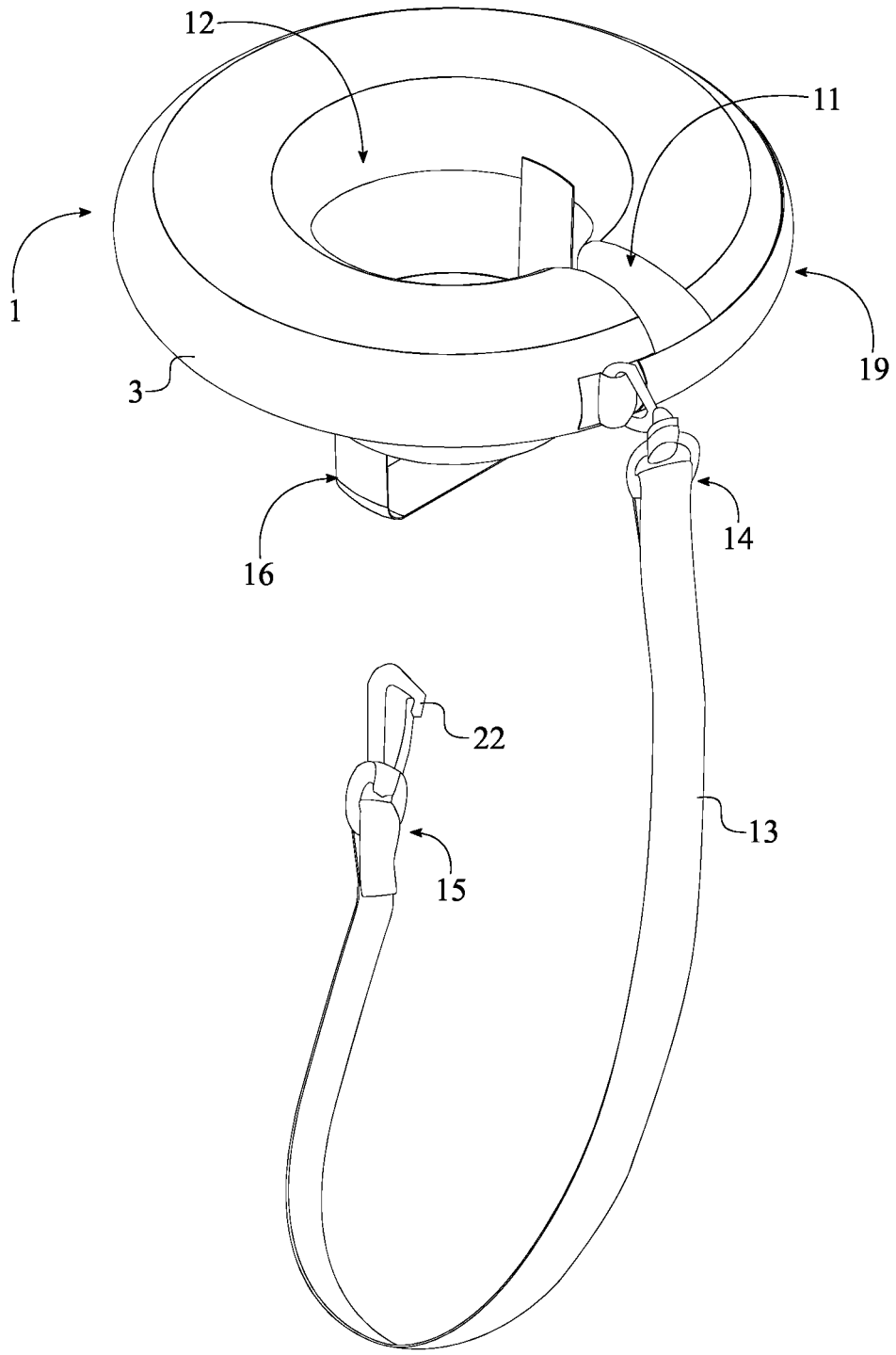
FIG. 1 is a top perspective view of the present invention.
Figure 2:
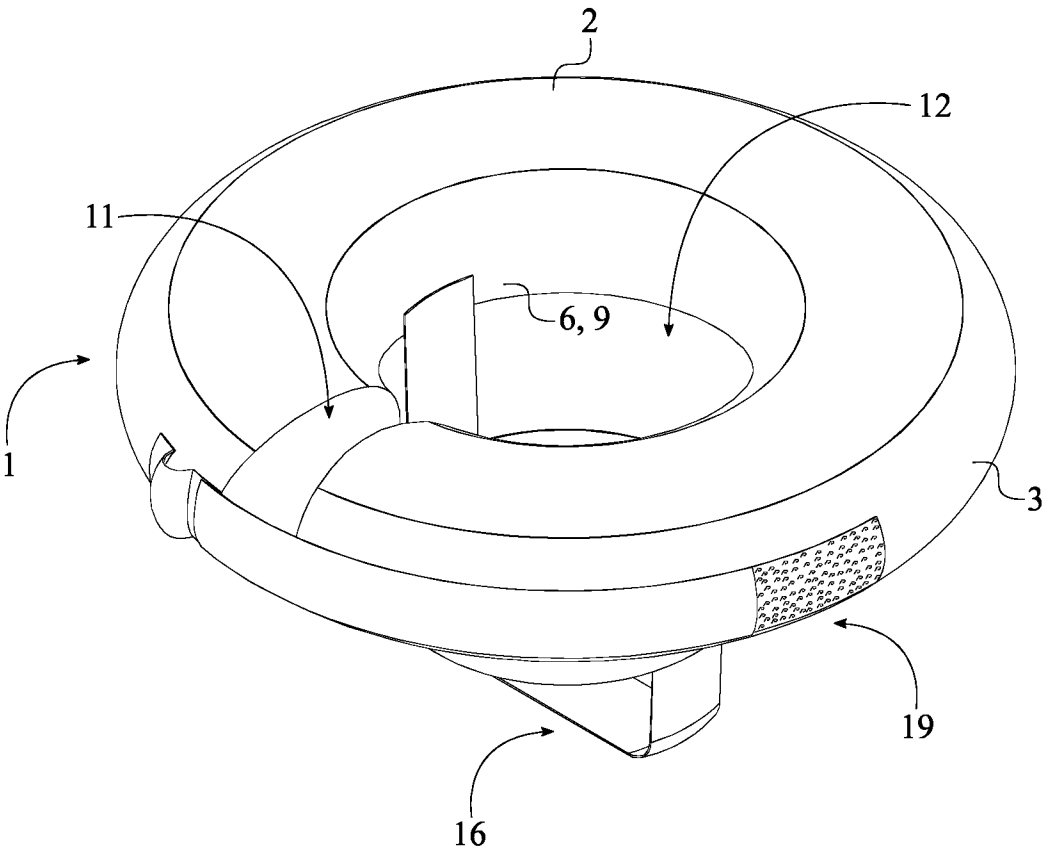
FIG. 2 is a top perspective view of the present invention without the attachment strap.
Figure 3:
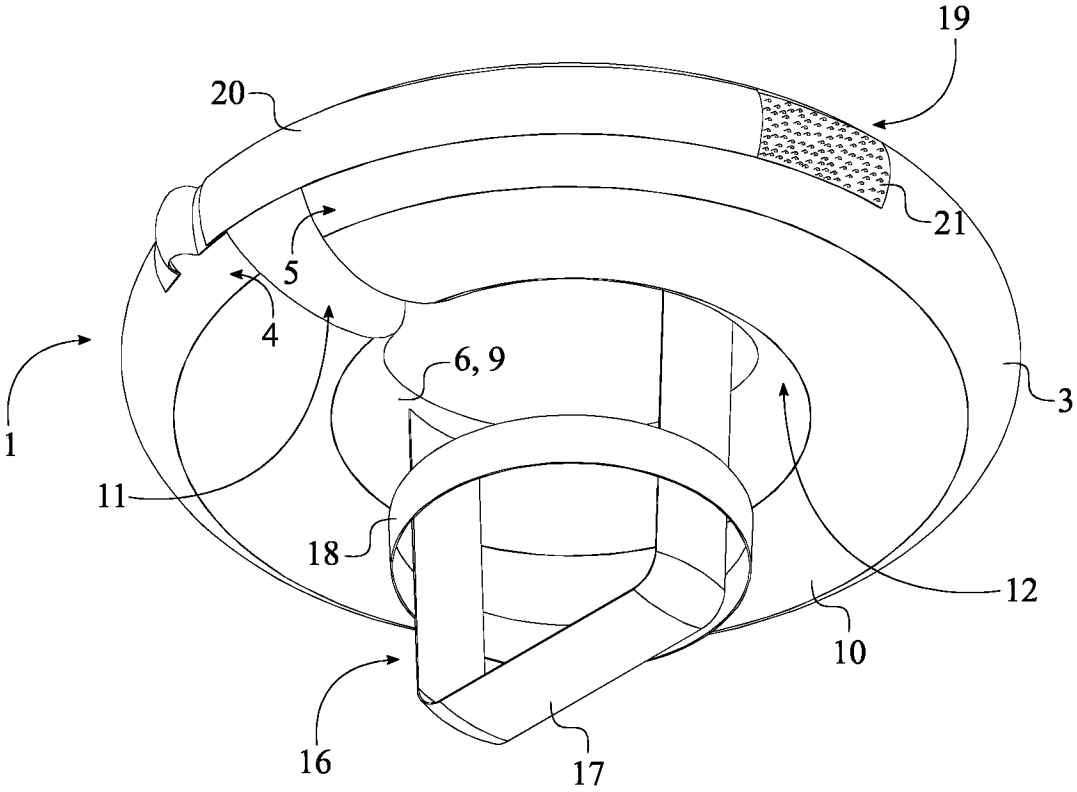
FIG. 3 is a bottom perspective view of the present invention without the attachment strap.

As shown in FIG. 1-3, the present invention comprises a c-shaped body 1, an attachment strap 13, a webbing 16, and a collapsible fastener 19. In reference to a general configuration of the present invention, the c-shaped body 1 functions as the floating body to receive a beverage container. The webbing 16 is connected to the c-shaped body 1 and secures the bottom half of the beverage container that submerges in the water. The collapsible fastener 19 is laterally connected onto the c-shaped body 1 so that the beverage container can be firmly secured within the c-shaped body 1. The attachment strap 13 is laterally connected onto the c-shaped body 1 so that the user can clip to the c-shaped body 1 to user's bathing suit, tie to the user's wrist, or any other stationary objects.

The c-shaped body 1 enables the present invention to adapt and adjust according to the size of the beverage container. In other words, the present invention can firmly secure different size and shaped beverage containers due to the c-shaped body 1. In reference to FIG. 2-3, the c-shaped body 1 comprises a top surface 2, an outer lateral surface 3, an inner lateral surface 6, a bottom surface 10, a lateral opening 11, and a central opening 12. The inner lateral surface 6 comprises a first section 7, a second section 8, and a curved section 9 so that the general form of the c-shaped body 1 can be delineated with respect to the lateral opening 11 and the central opening 12. The top surface 2 and the bottom surface 10 are perimetrically connected to each other by the outer lateral surface 3 and the inner lateral surface 6 thus forming an enclosure. Furthermore, the top surface 2, the outer lateral surface 3, and the bottom surface 10 can be utilized to print graphical content and advertising content so that the present invention can be customized according to the user's preference. The central opening 12 is delineated by the curved section 9 so that the beverage container can be easily placed within the c-shaped body 1. The lateral opening 11 is delineated in between the first section 7 and the second section 8, allowing the c-shaped body 1 to radially tighten or loosen the stored beverage container. In other words, the lateral opening 11 is a radial gap section within the c-shaped body 1 and intersects with the central opening 12 thus allowing the c-shaped body 1 to adjust according to the size of the beverage container.

Figure 4:
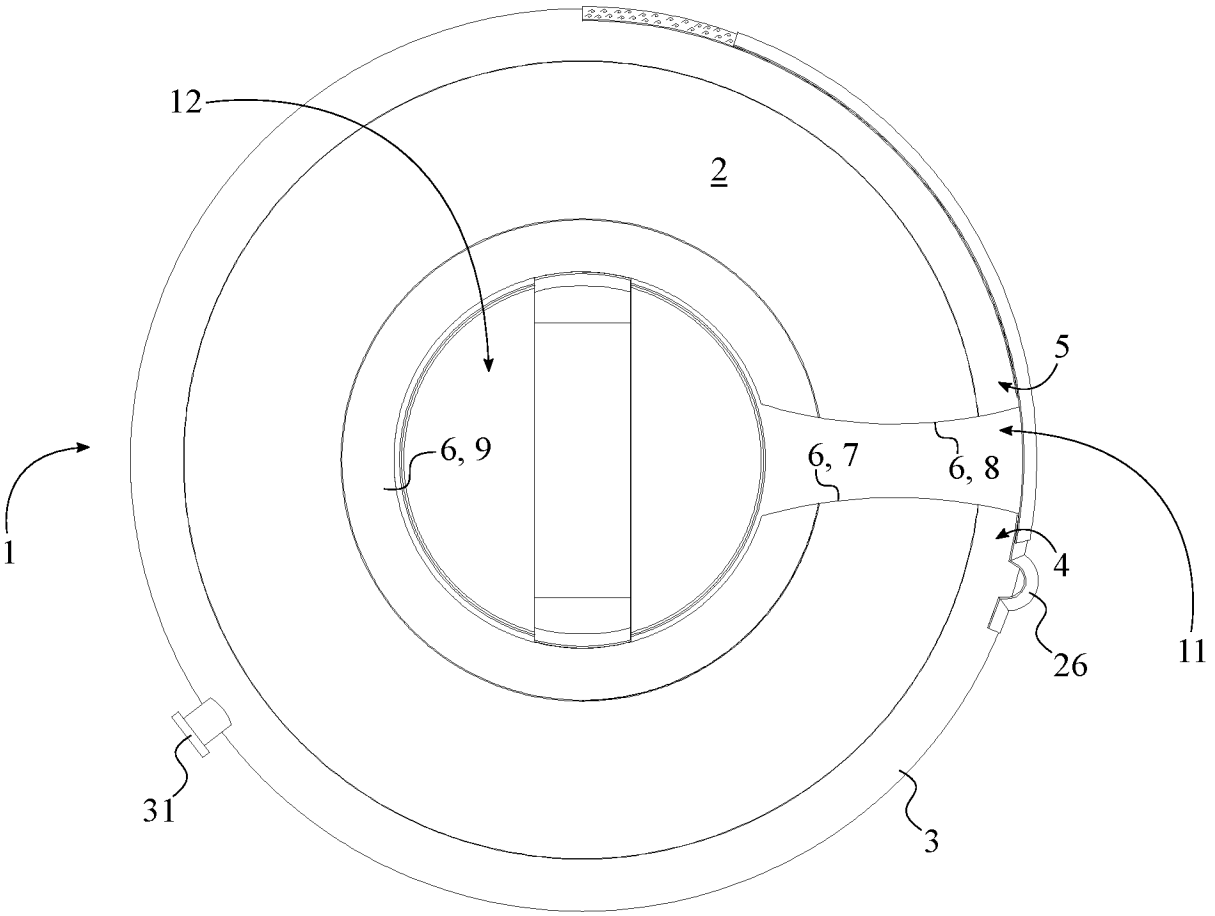
FIG. 4 is a top view of the present invention without the attachment strap.

As shown in FIG. 4, a first end 4 of the outer lateral surface 3 and the first section 7 are terminally connected to each other about the lateral opening 11 so that the inner lateral surface 6 can connect with the outer lateral surface 3 about the first section 7. A second end 5 of the outer lateral surface 3 and the second section 8 are terminally connected to each other about the lateral opening 11 so that the inner lateral surface 6 can connect with the outer lateral surface 3 about the second section 8. As a result, the distance between the first section 7 and the second section 8 delineates the width of the lateral opening 11. The length of the first section 7 and the length of the second section 8 delineate the length of the lateral opening 11. The curved section 9 is terminally connected to the first section 7 and the second section 8, opposite of the first end 4 and the second end 5. As a result, the central opening 12 is delineated within the c-shaped body 1 and along the arc length of the curved section 9.

In some embodiments of the present invention, as shown in FIG. 4, the c-shaped body 1 is an inflatable body for ease and convenience for travel and storage. More specifically, the top surface 2 and the bottom surface 10 are hermetically connected to each other by the outer lateral surface 3 and the inner lateral surface 6. As a result, once air is pumped into the inflatable body via an integrated air inlet 31, air can be trapped within the inflatable body with the airtight closing of the integrated air inlet 31 (i.e., a selectively-openable air inlet). Morever, the integrated air inlet 31 is externally positioned to the c-shaped body 1 and is integrated into the c-shaped body 1. Then, the user is able to use the present invention.

Figure 5:
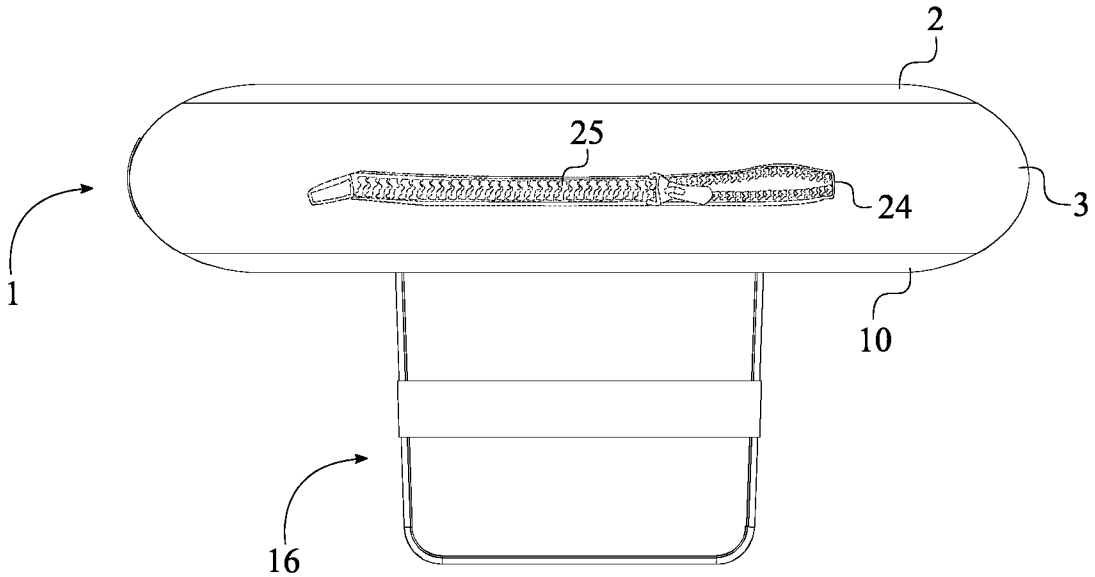
FIG. 5 is a side view of the present invention showing the access slit and the interlocking fastener of the c-shaped body.
Figure 6:
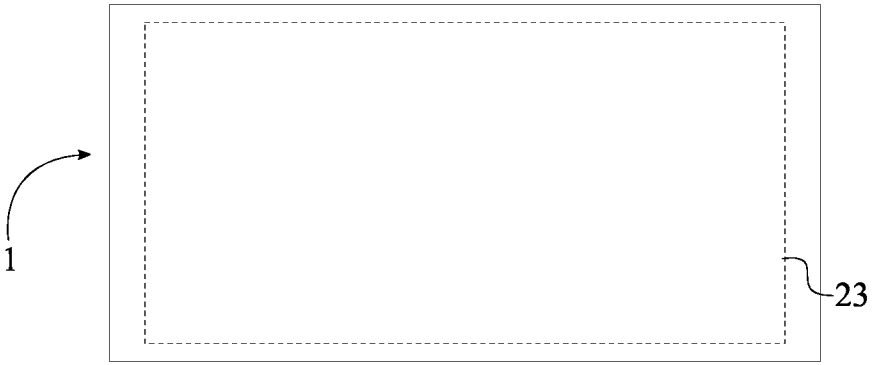
FIG. 6 is a basic schematic view of the present invention showing the internal positioning of the inner inflatable body within the c-shaped body.

In some embodiments of the present invention, an inner inflatable body 23 is enclosed by the c-shaped body 1 for ease and convenience for travel and storage. As shown in FIG. 5-6, an access slit 24 traverses through the outer lateral surface 3 so that the c-shaped body 1 can receive and enclose the inner inflatable body 23 via the access slit 24. An interlocking fastener 25 is integrated into the access slit 24 in order to fully secure the inner inflatable body 23 within the c-shaped body 1. Due to the possible separation of the c-shaped body 1 and the inner inflatable body 23, the user can interchange aesthetically different c-shaped bodies 1 around the inner inflatable body 23.

The collapsible fastener 19 is connected onto the outer lateral surface 3 and extended across the lateral opening 11 so that the width of the lateral opening 11 and the diameter of the central opening 12 can be adjusted. In reference to FIG. 3, the collapsible fastener 19 comprises a first interlocking strap 20 and a second interlocking strap 21. The first interlocking strap 20 is terminally connected to the first end 4 of the outer lateral surface 3 and outwardly extended away from the first end 4. The second interlocking strap 21 is perimetrically connected onto the second end 5 of the outer lateral surface 3. In order to firmly secure the beverage container within the central opening 12, the first interlocking strap 20 is extended across the lateral opening 11 and adjustably attached onto the second interlocking strap 21. The present invention preferably utilizes a hook and loop fastener as the first interlocking strap 20 and the second interlocking strap 21 so that the user can easily adjust the lateral opening 11 and the central opening 12. However, the present invention can use any other types of easily detachable fasteners as the first interlocking strap 20 and the second interlocking strap 21 other than the hook and loop fastener. Furthermore, once the beverage container is secured to the c-shaped body 1 via the collapsible fastener 19, the beverage container does not have to be removed from the present invention for consumption. The user can easily grasp the bottom half of the beverage container and lift up both the beverage container and the present invention for beverage consumption.

The webbing 16 is terminally connected onto the curved section 9 of the inner lateral surface 6 so that the beverage container is able to stay upright within the central opening 12. In reference to FIG. 3, the webbing 16 comprises at least one strap 17 and at least one loop 18. The strap 17 is terminally connected to the curved section 9 so that a base and a lateral wall of the beverage container can be supported. The loop 18 is radially positioned and laterally connected onto the strap 17 so that the lateral wall of the beverage container can be further supported. Even though the preferred embodiment utilizes a single strap 17 and a single loop 18 to structurally configure the webbing 16, the present invention can also utilize multiple straps 17 and loops 18 to structurally configure the webbing 16.

In reference to FIG. 1, the attachment strap 13 is pivotably mounted onto the outer lateral surface 3 so that that the c-shaped body 1 and the secured beverage container never float away from the user. More specifically, a proximal strap end 14 of the attachment strap 13 is pivotably mounted onto the outer lateral surface 3 so that the movement of the c-shaped body 1 does not affect the positioning of the attachment strap 13. A distal clip 22 is connected to a distal strap end 15 of the attachment strap 13 so that the user can easily secure the attachment strap 13 to user's bathing suit, to the user's wrist, or any other stationary objects.

Moreover, primarily in reference to FIG. 1 and secondarily in reference to FIG. 2-4, in some embodiments of the present invention, the present invention further comprises an eyelet 26, a proximal clip 27, a pivotable joint 28, and a proximal d-ring 29, while the proximal strap end 14 is a strap loop. The eyelet 26 is externally connected to the outer lateral surface 3, adjacent to the first section 7, and is oriented parallel to the central opening 12. The eyelet 26 is hingedly connected to the pivotable joint 28 by the proximal clip 27, while the proximal strap end 14 is hingedly connected to the pivotable joint 28 by the proximal d-ring 29.

In addition, in reference to FIG. 1, in some embodiments of the present invention, the present invention further comprises a distal d-ring 30, while the distal strap end 15 is a strap loop. The distal strap end 15 is hingedly connected to the distal clip 22 by the distal d-ring 30.

Although the invention has been explained in relation to its preferred embodiment, it is to be understood that many other possible modifications and variations can be made without departing from the spirit and scope of the invention as hereinafter claimed.

What is claimed is:

1. A floating beverage holding apparatus comprising:

a c-shaped body;

an attachment strap;

a webbing;

a collapsible fastener;

a distal clip;

a selectively-openable air inlet;

the c-shaped body comprising a top surface, an outer lateral surface, an inner lateral surface, a bottom surface, a lateral opening, and a central opening;

the webbing comprising at least one strap and at least one loop;

the inner lateral surface comprising a first section, a second section, and a curved section;

the top surface and the bottom surface being perimetrically connected to each other by the outer lateral surface and the inner lateral surface;

the lateral opening being delineated in between the first section and the second section;

the central opening being delineated by the curved section;

the c-shaped body being an inflatable body;

the top surface and the bottom surface being hermetically connected to each other by the outer lateral surface and the inner lateral surface;

the selectively-openable air inlet being externally positioned to the c-shaped body;

the selectively-openable air inlet being integrated into the c-shaped body;

the attachment strap being pivotably mounted onto the outer lateral surface;

the webbing being terminally connected onto the curved section of the inner lateral surface;

the collapsible fastener being connected onto the outer lateral surface; and the collapsible fastener being extended across the lateral opening;

the at least one strap being terminally connected to the curved section;

the at least one loop being radially positioned to the strap;
the at least one loop being laterally connected onto the strap;
the at least one loop being positioned concentric to the curved section;
a proximal strap end of the attachment strap being pivotably mounted onto the outer lateral surface; and
the distal clip being connected to a distal strap end of the attachment strap.

2. The floating beverage holding apparatus as claimed in claim 1 comprising:
a first end of the outer lateral surface and the first section being terminally connected to each other about the lateral opening;
a second end of the outer lateral surface and the second section being terminally connected to each other about the lateral opening; and
the curved section being terminally connected to the first section and the second section.

3. The floating beverage holding apparatus as claimed in claim 1 comprising:
the collapsible fastener comprising a first interlocking strap and a second interlocking strap;
the first interlocking strap being terminally connected to a first end of the outer lateral surface;
the first interlocking strap being outwardly extended away from the first end;
the second interlocking strap being perimetrically connected onto a second end of the outer lateral surface;
the first interlocking strap being adjustably attached onto the second interlocking strap; and
the first interlocking strap being extended across the lateral opening.

4. The floating beverage holding apparatus as claimed in claim 1 comprising:
an eyelet;
a proximal clip;
a pivotable joint;
a proximal D-ring;
the proximal strap end being a strap loop;
the eyelet being externally connected to the outer lateral surface, adjacent to the first section;
the eyelet being oriented parallel to the central opening;
the eyelet being hingedly connected to the pivotable joint by the proximal clip; and
the proximal strap end being hingedly connected to the pivotable joint by the proximal D-ring.

5. The floating beverage holding apparatus as claimed in claim 1 comprising:
a distal D-ring;
the distal strap end being a strap loop; and
the distal strap end being hingedly connected to the distal clip by the distal D-ring.

6. A floating beverage holding apparatus comprising:
a c-shaped body;
an attachment strap;
a webbing;
a collapsible fastener;
a distal clip;
an inner inflatable body;
an access slit;
an interlocking fastener;
the c-shaped body comprising a top surface, an outer lateral surface, an inner lateral surface, a bottom surface, a lateral opening, and a central opening;
the webbing comprising at least one strap and at least one loop;
the inner lateral surface comprising a first section, a second section, and a curved section;
the top surface and the bottom surface being perimetrically connected to each other by the outer lateral surface and the inner lateral surface;
the lateral opening being delineated in between the first section and the second section;
the central opening being delineated by the curved section;
the c-shaped body being an external covering;
the inner inflatable body being enclosed by the c-shaped body;
the access slit traversing through the outer lateral surface;
the interlocking fastener being integrated into the access slit;
the attachment strap being pivotably mounted onto the outer lateral surface;
the webbing being terminally connected onto the curved section of the inner lateral surface;
the collapsible fastener being connected onto the outer lateral surface;
the collapsible fastener being extended across the lateral opening;
the at least one strap being terminally connected to the curved section;
the at least one loop being radially positioned to the strap;
the at least one loop being laterally connected onto the strap;
the at least one loop being positioned concentric to the curved section;
a proximal strap end of the attachment strap being pivotably mounted onto the outer lateral surface; and
the distal clip being connected to a distal strap end of the attachment strap.

7. The floating beverage holding apparatus as claimed in claim 6 comprising:
a first end of the outer lateral surface and the first section being terminally connected to each other about the lateral opening;
a second end of the outer lateral surface and the second section being terminally connected to each other about the lateral opening; and
the curved section being terminally connected to the first section and the second section.

8. The floating beverage holding apparatus as claimed in claim 6 comprising:
the collapsible fastener comprising a first interlocking strap and a second interlocking strap;
the first interlocking strap being terminally connected to a first end of the outer lateral surface;
the first interlocking strap being outwardly extended away from the first end;
the second interlocking strap being perimetrically connected onto a second end of the outer lateral surface;
the first interlocking strap being adjustably attached onto the second interlocking strap; and
the first interlocking strap being extended across the lateral opening.

9. The floating beverage holding apparatus as claimed in claim 6 comprising:
an eyelet;
a proximal clip;
a pivotable joint;
a proximal d-ring;
the proximal strap end being a strap loop;
the eyelet being externally connected to the outer lateral surface, adjacent to the first section;

the eyelet being oriented parallel to the central opening;

the eyelet being hingedly connected to the pivotable joint by the proximal clip; and the proximal strap end being hingedly connected to the pivotable joint by the proximal d-ring.

10. The floating beverage holding apparatus as claimed in claim 6 comprising:

a distal d-ring;

the distal strap end being a strap loop; and the distal strap end being hingedly connected to the distal clip by the distal d-ring.

* * * * *